US007077107B2

(12) United States Patent
Boos et al.

(10) Patent No.: US 7,077,107 B2
(45) Date of Patent: Jul. 18, 2006

(54) FUEL-INJECTION DEVICE FOR AN INTERNAL COMBUSTION ENGINE

(75) Inventors: Burkhard Boos, Lambsborn (DE); Stefan Kieferle, Stuttgart (DE); Matthias Distel, Ostfildern (DE); Achim Koehler, Ditzingen (DE); Sascha Ambrock, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/474,323

(22) PCT Filed: Dec. 24, 2002

(86) PCT No.: PCT/DE02/04724

§ 371 (c)(1),
(2), (4) Date: Mar. 24, 2004

(87) PCT Pub. No.: WO03/067075

PCT Pub. Date: Aug. 14, 2003

(65) Prior Publication Data

US 2004/0155120 A1 Aug. 12, 2004

(30) Foreign Application Priority Data

Feb. 8, 2002 (DE) ..... 102 05 187

(51) Int. Cl.
*F02M 37/04* (2006.01)

(52) U.S. Cl. ..... 123/446; 123/456

(58) Field of Classification Search ..... 123/446, 123/456, 447, 458

See application file for complete search history.

(56) References Cited

U.S. PATENT DOCUMENTS

| | | | | |
|---|---|---|---|---|
| 4,719,889 | A * | 1/1988 | Amann et al. | 123/447 |
| 4,884,545 | A * | 12/1989 | Mathis | 123/447 |
| 5,701,873 | A * | 12/1997 | Schneider | 123/516 |
| 5,884,606 | A * | 3/1999 | Kellner et al. | 123/446 |
| 6,170,466 | B1 | 1/2001 | Klinger et al. | |
| 6,293,253 | B1 * | 9/2001 | Arnold et al. | 123/458 |
| 6,581,577 | B1 * | 6/2003 | Geyer | 123/514 |
| 6,694,950 | B1 * | 2/2004 | Djordjevic | 123/446 |
| 6,722,857 | B1 * | 4/2004 | Kellner et al. | 417/255 |
| 6,748,923 | B1 * | 6/2004 | Grossner et al. | 123/446 |
| 6,772,734 | B1 * | 8/2004 | Schueler | 123/446 |
| 2001/0022171 | A1 * | 9/2001 | Gaessler et al. | 123/446 |
| 2002/0034448 | A1 | 3/2002 | De Matthaeis | |

FOREIGN PATENT DOCUMENTS

| | | | |
|---|---|---|---|
| DE | 197 25 474 | A1 | 12/1998 |
| DE | 199 07 311 | A1 | 8/2000 |
| EP | 1 088 984 | A2 | 4/2001 |
| WO | WO 01/40656 | A1 | 6/2001 |

* cited by examiner

*Primary Examiner*—Carl S. Miller
(74) *Attorney, Agent, or Firm*—Ronald E. Greigg

(57) ABSTRACT

Fuel injection system having a feed pump by which fuel is pumped out of a fuel tank to the intake side of a high-pressure pump pumps fuel into a reservoir as a function of engine operating parameters. A fuel metering device is provided for adjusting the fuel quantity pumped into the reservoir by the high-pressure pump. An electrically actuated blocking valve is disposed between the feed pump and the high-pressure pump, and by means of this valve the high-pressure pump can be disconnected completely from the feed pump. By means of the blocking valve, it can still be attained that no fuel is pumped by the high-pressure pump even if the fuel metering device does not provide complete sealing.

8 Claims, 2 Drawing Sheets

10
40
42
46
44
46
23
12
P
24
23
26
39
34
32
36
38
30
28
17
20
22
16
14

FUEL-INJECTION DEVICE FOR AN INTERNAL COMBUSTION ENGINE

CROSS-REFERENCE TO RELATED APPLICATIONS

This application is a 35 USC 371 application of PCT/DE 02/04724 filed on Dec. 24, 2002.

BACKGROUND OF THE INVENTION

1. Field of the Invention

The invention is directed to an improved fuel injection system for an internal combustion engine.

2. Description of the Prior Art

One fuel injection system known from German Patent Disclosure DE 198 53 103 A1 has a feed pump by which fuel is pumped to a high-pressure pump, and the high-pressure pump pumps fuel at high pressure into a reservoir. A fuel metering device is also provided, which is disposed between the feed pump and the high-pressure pump. The fuel metering device serves to control the fuel quantity, pumped into the reservoir by the high-pressure pump, as a function of engine operating parameters. The fuel metering device includes an actuator in the form of an electromagnet and a regulating valve, actuated by the electromagnet, that has a slidelike valve member which is movable counter to a restoring spring by an armature of the electromagnet. In cooperation with an outflow opening of the valve housing, via its outer jacket, the valve member controls a flow cross section from the feed pump to the high-pressure pump as a function of its stroke. In a closing position of the valve member, the valve member has its outer jacket overlapping with the outlet opening, so that the flow cross section is completely closed. However, since the valve member must be displaceable in the cylinder bore of the valve housing, a slight gap must be present between its outer jacket and the cylinder bore, through which a leakage quantity of fuel can pass and reach the outlet opening to the high-pressure pump, even when no fuel is to be pumped by the high-pressure pump because of the engine operating parameters, for instance in the overrunning mode. Provisions are therefore required to carry this leakage quantity of fuel away so that it cannot reach the high-pressure pump. To that end, a bypass connection from the outlet of the feed pump to the fuel tank is provided, in which there is a throttle restriction. This makes the layout and manufacture of the fuel injection system complicated.

SUMMARY OF THE INVENTION

The fuel injection system of the invention has the advantage over the prior art that by means of the blocking valve, it is simple to attain the situation where no more fuel is pumped by the high-pressure pump.

Advantageous features and refinements of the fuel injection system of the invention are disclosed. By means of one embodiment adequate lubrication of the drive region of the high-pressure pump is assured, even when the high-pressure pump is not pumping any fuel.

BRIEF DESCRIPTION OF THE DRAWINGS

Two exemplary embodiments of the invention are described in detail herein below, with reference to the drawings, in which.

DESCRIPTION OF THE PREFERRED EMBODIMENTS

Figure 1:
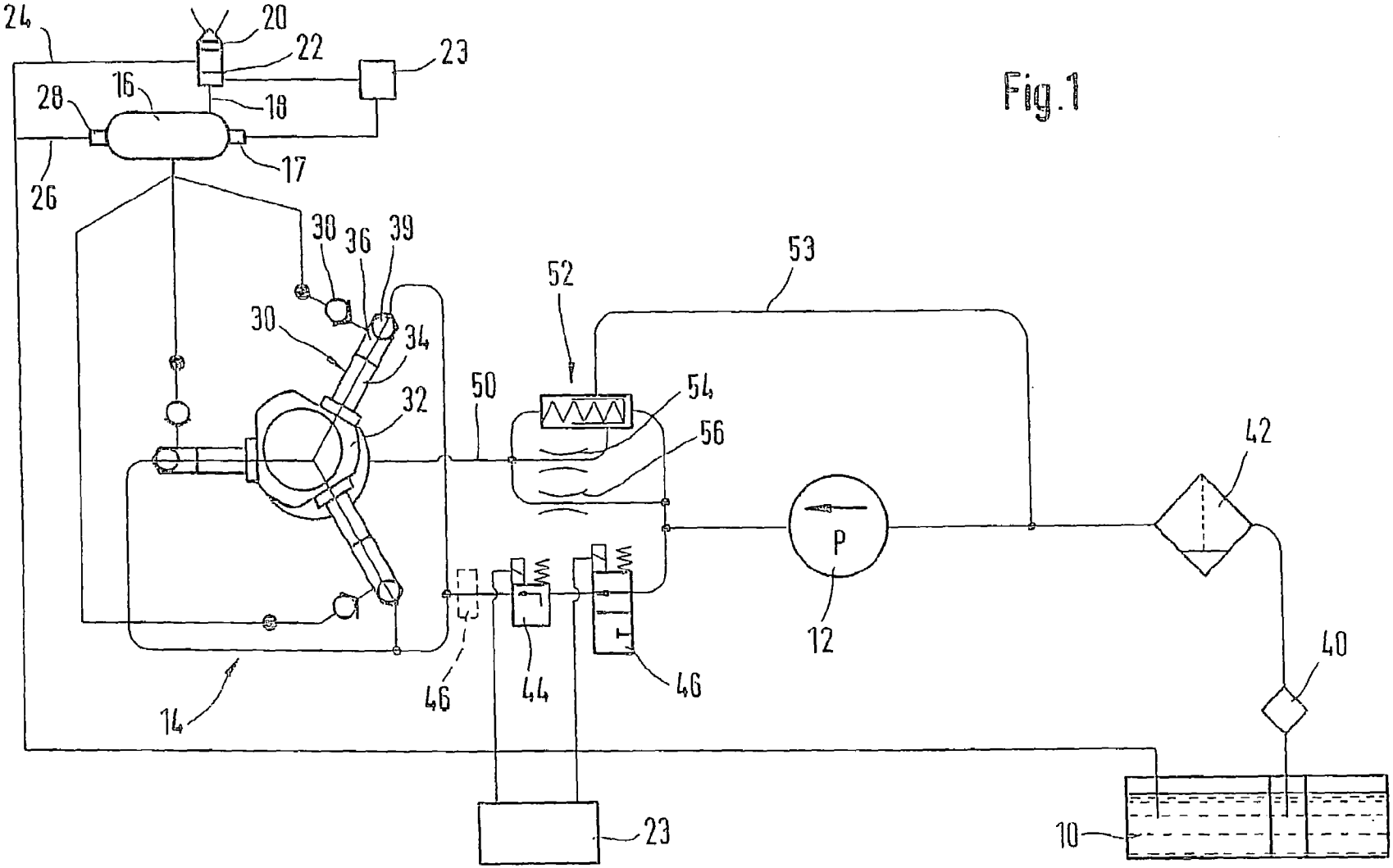
FIG. 1 shows a fuel injection system for an internal combustion engine schematically in accordance with a first exemplary embodiment.
Figure 2:
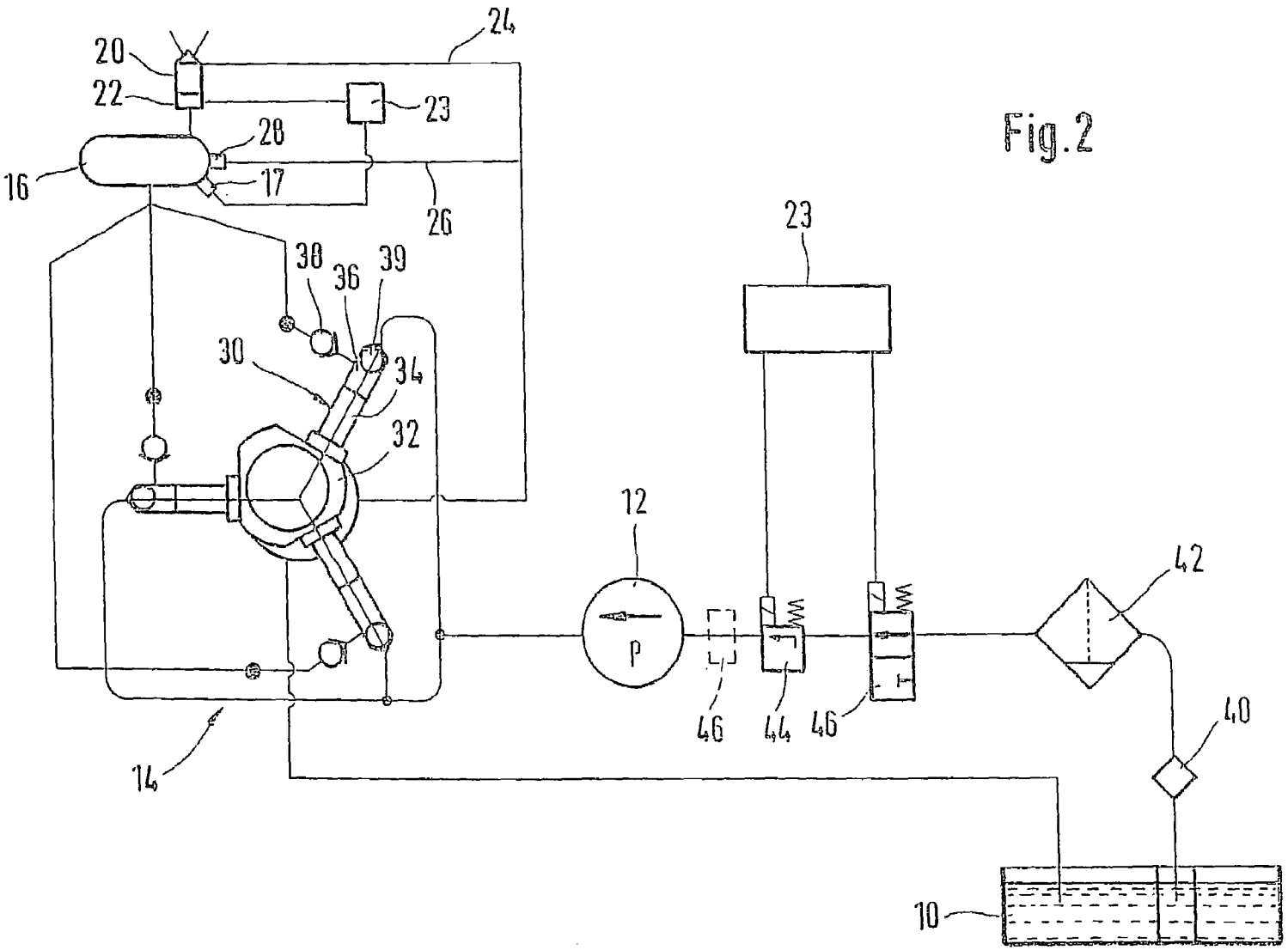
FIG. 2 shows the fuel injection system in accordance with a second exemplary embodiment.

In FIGS. 1 and 2, a fuel injection system for an internal combustion engine, for instance of a motor vehicle, is shown. The engine is preferably a self-igniting engine and has one or more cylinders. The motor vehicle has a fuel tank 10, in which fuel is stored for operating the engine. The fuel injection system has a feed pump 12, by which fuel is pumped out of the fuel tank 10 to a high-pressure pump 14. The high-pressure pump 14 pumps fuel into a reservoir 16, which can for instance be tubular or embodied in some arbitrary other shape. From the reservoir 16, lines 18 lead to injectors 20 disposed at the cylinders of the engine. One electric control valve 22 is disposed at each of the injectors 20 and controls an opening of the injectors so as to effect a fuel injection through the respective injector 20 or prevent a fuel injection. The control valves 22 are triggered by an electronic control unit 23, by which the instant and duration of the fuel injection by the injectors 20 is determined as a function of engine operating parameters, such as rpm, load, temperature, and others. From the injectors 20, a return for unconsumed fuel leads back at least indirectly to the fuel tank 10, for instance via a line 24 common to all the injectors. From the reservoir 16, a line 26 in which a pressure limiting valve 28 is disposed, to prevent an excessively high pressure from building up in the reservoir 16, can also lead back to the fuel tank 10.

The high-pressure pump 14 is driven mechanically by the engine and thus in proportion to the engine rpm. The feed pump 12 can also be driven mechanically by the engine; a common drive shaft may be provided for both the high-pressure pump 14 and the feed pump 12. Alternatively, the feed pump 12 can have an electric-motor drive mechanism, for instance.

The high-pressure pump 14 can be embodied as a radial piston pump and has a plurality of pump elements 30, for instance three of them, disposed at equal angular intervals from one another, which each have a pump piston 34, driven in a reciprocating motion by a polygon 32 in conjunction with an eccentric shaft, and each pump piston defines a respective pump work chamber 36. A check valve 38 opening toward the reservoir 16 is disposed in the connections between the pump work chambers 36 and the reservoir 16, and by means of the check valve, the disconnection between the pump work chambers 36 and the reservoir 16 is effected in the intake stroke of the pump pistons 34. In each of the connections of the pump work chambers 36 with the feed pump 12, there is a respective check valve 39, opening toward the pump work chambers 36, and by means of this valve the disconnection between the pump work chambers 36 and the feed pump 12 is effected in the pumping stroke of the pump pistons 34. During each intake stroke of the pump pistons 34, when they are moving radially inward, the pump work chambers 36, with the check valves 39 open, communicate with the outlet of the feed pump 12 and are filled with fuel; the pump work chambers 36 are disconnected from the reservoir 16 by the closed check valves 38. During each pumping stroke of the pump pistons 34, when they are moving radially outward, the pump work chambers 36, with the check valves 38 open, communicate with the reservoir 16, while they are disconnected from the outlet of the feed pump 12 by the closed check valves 39.

One or more filters are preferably disposed between the feed pump 12 and the fuel tank 10. For instance, beginning at the fuel tank 10, there can first be a coarse filter 40 and downstream of it a fine filter 42; the fine filter 42 can additionally have a water separator.

The fuel injection system furthermore has a fuel metering device 44, which in a first exemplary embodiment shown in FIG. 1 is disposed between the feed pump 12 and the high-pressure pump 14. The fuel metering device 44 has a regulating valve 46, actuated by an electric actuator 23, such as an electromagnet or a piezoelectric actuator, by means of which regulating valve the flow from the feed pump 12 to the high-pressure pump 14 is continuously adjustable. The fuel metering device 44 is likewise triggered by the control unit 23, in such a way that the high-pressure pump 14 is supplied with a defined fuel quantity, which is then in turn pumped at high pressure by the high-pressure pump 14 into the reservoir 16, in order to maintain a predetermined pressure that is dependent on engine operating parameters in the reservoir 16. A pressure sensor 17 is disposed at the reservoir 16 and communicates with the control unit 23 and thus receives signals about the actual pressure in the reservoir 16 and triggers the fuel metering device 44 such that the flow of fuel to the high-pressure pump 14 is set in such a way that the predetermined pressure in the reservoir 16 is attained.

An electrically actuatable blocking valve 46 is disposed between the outlet of the feed pump 12 and the fuel metering device 44, and by way of it the fuel metering device 44 and thus the high-pressure pump 14 can be disconnected completely from the feed pump. The blocking valve 46 is embodied as a 2/2-way valve, which can be switched back and forth between a completely open and a completely closed switching position. The blocking valve 46 has an actuator which for example can be an electromagnet or a piezoelectric actuator, and which is triggered by the control unit 23. If no fuel is to be pumped into the reservoir 16 by the high-pressure pump 14 because of certain engine operating parameters, for instance in the overrunning mode, then the blocking valve 46 is put in its closed switching position by the control unit 23. When fuel is to be pumped into the reservoir 16 by the high-pressure pump 14, the blocking valve 46 is put in its open switching position by the control unit 23, and the flow from the feed pump 12 to the high-pressure pump 14 is regulated by the fuel metering device 44. Alternatively, the blocking valve 46 can be disposed between the fuel metering device 44 and the high-pressure pump 14, as shown in dashed lines in FIG. 1. The function of the blocking valve 46 is then the same as that described above. Because by means of the blocking valve 46 the flow of fuel to the high-pressure pump 14 can be blocked completely, the check valves 39 of the pump elements 30 can be designed such that they already open at a slight pressure. This makes good filling of the pump work chambers 36 possible in the intake stroke of the pump pistons 34, along with good volumetric efficiency of the high-pressure pump 14.

Provision can be made so that a connection 50 to a drive region of the high-pressure pump 14 extends from the outlet of the feed pump 12 to a drive region of the high-pressure pump 14, parallel to the fuel metering device 44. The drive region of the high-pressure pump 14 is formed by the eccentric shaft with the polygon and with the pump piston 34 attached to the polygon and leading away from it. Through the connection 50, fuel used for lubrication is delivered to the drive region. The connection 50 is controlled by a pressure valve 52. When the predetermined opening pressure of the pressure valve 52 is exceeded by the feed pump 12, the pressure valve 52 opens and uncovers the connection 50, so that fuel reaches the drive region, where it assures adequate lubrication. The pressure valve 52 furthermore has a connection 53, through which the overflow quantity of fuel is returned to the intake side of the feed pump 12. Downstream of the pressure valve 52, a throttle restriction 54 in the connection 50 is provided, by which the flow through the connection 50 is limited so that an excessive fuel quantity will not be diverted to the drive region of the high-pressure pump 14. When the engine is started, initially only a slight fuel quantity, which is needed for building up pressure in the reservoir 16 and for fuel injection, is pumped by the feed pump 12 and the high-pressure pump 14 that is driven as a function of rpm. During this time, the pressure valve 52 is closed, so that no fuel quantity for lubricating the high-pressure pump 14 is diverted; instead, the entire fuel quantity pumped by the feed pump 12 is delivered to the high-pressure pump 14. Parallel to the pressure valve 52, a further throttle restriction 56 can be provided in the connection 50; by way of this throttle restriction, the drive region of the high-pressure pump 14 is in constantly open communication with the feed pump 12, which makes venting possible.

If no fuel is pumped by the high-pressure pump 14 when the blocking valve 46 is closed, such as in the engine overrunning mode, fuel can continue to be pumped by the feed pump 12; this fuel is delivered to the drive region of the high-pressure pump 14 for its lubrication via the open pressure valve 52 and/or the further throttle restriction 56, and part of it is diverted as an overflow quantity to the intake side of the feed pump 12, via the connection 53.

In FIG. 2, the fuel injection system is shown in a second exemplary embodiment. The fuel metering device 44 is disposed here between the fuel tank 10 and the feed pump 12. The blocking valve 46 is disposed between the fuel tank 10 and the fuel metering device 44 and otherwise is embodied the same as in the first exemplary embodiment. Alternatively, the blocking valve 46 can, as shown in dashed lines in FIG. 2, be disposed between the fuel metering device 44 and the feed pump 12 instead. If no fuel is to be pumped by the high-pressure pump 14, the blocking valve 46 is put in its closed switching position by the control unit 23. In that case, no further fuel is pumped by the feed pump 12, either; hence lubrication of the drive region of the high-pressure pump 14 must be assured in some other way, for instance making the return 24 from the injectors 20 lead into the drive region.

The foregoing relates to preferred exemplary embodiments of the invention, it being understood that other variants and embodiments thereof are possible within the spirit and scope of the invention, the latter being defined by the appended claims.

The invention claimed is:

1. A fuel injection system for an internal combustion engine, comprising a feed pump (12) by which fuel is pumped from a fuel tank (10) to the intake side of a high-pressure pump (14), and the high-pressure pump (14) pumps fuel into a reservoir (16) as a function of engine operating parameters, an electrically operated fuel metering device (44) for setting the fuel quantity pumped into the reservoir (16) by the high-pressure pump (14), and an electrically operated blocking valve (46) disposed between the feed pump (12) and the high-pressure pump (14), the blocking valve (46) being operable to disconnect the high-pressure pump (14) completely from the feed pump (12), wherein the fuel metering device (44) is disposed between the feed pump (12) and the high-pressure pump (14); and wherein the blocking valve (46) is either disposed in series with the fuel metering device (44), between the latter and the feed pump (12), or between the fuel metering device (44) and the high-pressure pump (14).

2. The fuel injection system of claim 1, wherein the blocking valve (46) is embodied as a 2/2-way valve.

3. The fuel injection system of claim 1, wherein the high-pressure pump (14) comprises a drive region (32), which for its lubrication has a connection (50) with the outlet of the feed pump (12), this connection extending parallel to the fuel metering device (44) and to the blocking valve (46).

4. The fuel injection system of claim 2, wherein the high-pressure pump (14) comprises a drive region (32), which for its lubrication has a connection (50) with the outlet of the feed pump (12), this connection extending parallel to the fuel metering device (44) and to the blocking valve (46).

5. The fuel injection system of claim 3, further comprising a pressure valve (52) that opens toward the drive region (32) controlling the connection (50) of the drive region (32) with the feed pump (12).

6. The fuel injection system of claim 4, further comprising a pressure valve (52) that opens toward the drive region (32) controlling the connection (50) of the drive region (32) with the feed pump (12).

7. The fuel injection system of claim 5, further comprising at least one throttle restriction (54; 56) in the connection (50) of the drive region (32) with the feed pump (12).

8. The fuel injection system of claim 6, further comprising at least one throttle restriction (54; 56) in the connection (50) of the drive region (32) with the feed pump.

* * * * *